US006021835A

United States Patent [19]

Malott

[11] Patent Number: 6,021,835

[45] **Date of Patent: *Feb. 8, 2000**

[54] RETRACTABLE DOOR/WINDOW AWNING

[75] Inventor: Dale G. Malott, Middlebury, Ind.

[73] Assignee: White Consolidated Industries, Inc., Cleveland, Ohio

[ * ] Notice: This patent is subject to a terminal disclaimer.

[21] Appl. No.: 09/162,250

[22] Filed: Sep. 28, 1998

Related U.S. Application Data

[63] Continuation-in-part of application No. 09/061,516, Apr. 16, 1998.

[51] Int. Cl.[7] ..... E04F 10/06

[52] U.S. Cl. ..... 160/67; 160/71; 160/72; 248/286.1; 135/88.1; 135/88.18; 403/109.1

[58] Field of Search ..... 160/67, 71, 72, 160/23.1, 59, 60, 70, 65, 276.1, 286.1, 22, 293.1; 135/88.1, 88.18; 296/160, 162, 163; 403/109.1; 292/538

[56] References Cited

U.S. PATENT DOCUMENTS

| | | | |
|---|---|---|---|
| 359,293 | 3/1887 | Thalheimer et al. . | |
| 1,285,804 | 11/1918 | Saylor | 160/67 |
| 3,324,869 | 6/1967 | Duda . | |
| 3,741,274 | 6/1973 | Youngblood, Jr. . | |
| 3,779,302 | 12/1973 | Akers et al. . | |
| 3,847,171 | 11/1974 | Akers et al. . | |
| 3,866,874 | 2/1975 | Upton, Jr. . | |
| 3,918,510 | 11/1975 | Hayward . | |
| 3,918,511 | 11/1975 | Upton, Jr. . | |
| 4,160,458 | 7/1979 | Marcellus . | |
| 4,180,117 | 12/1979 | Greer . | |
| 4,253,689 | 3/1981 | McKee . | |
| 4,508,126 | 4/1985 | Everard . | |
| 4,524,791 | 6/1985 | Greer . | |
| 4,576,192 | 3/1986 | Duda . | |
| 4,719,954 | 1/1988 | Curtis et al. . | |
| 4,759,396 | 7/1988 | Quinn . | |
| 4,862,940 | 9/1989 | Atchison . | |
| 5,148,848 | 9/1992 | Murray et al. . | |
| 5,172,743 | 12/1992 | Wallace et al. . | |
| 5,203,393 | 4/1993 | Blevins et al. . | |
| 5,407,007 | 4/1995 | Lowrey | 160/71 X |
| 5,752,556 | 5/1998 | Steadman | 160/71 X |
| 5,896,908 | 4/1999 | Kaun | 160/67 |

*Primary Examiner*—Daniel P. Stodola
*Assistant Examiner*—Bruce A. Lev
*Attorney, Agent, or Firm*—Pearne, Gordon, McCoy & Granger LLP

[57] ABSTRACT

A retractable awning assembly includes a roller, a flexible canopy having an inner edge secured to a wall and an outer edge secured to the roller, and a pair of arm assemblies operable to move the roller between a retracted position adjacent the wall and an extended position spaced from the wall. Each arm assembly includes a support arm and a rafter arm. The support arm includes telescoping inner and outer tubes, a bracket rigidly secured at an intermediate position along the inner tube, and a rearward facing button lock for automatically locking the tubes in extended relation. The rafter arm includes telescoping inner and outer tubes and a laterally inward facing button lock for automatically locking the tubes in extended relation. The support arm outer tube has an upper end operably connected to the roller and the support arm inner tube has a lower end pivotally secured to the wall. The rafter arm outer tube has an outer end pivotally connected to the support arm bracket and the rafter arm inner tube has an inner end pivotally secured to the wall. A travel latch for automatically locking the support arm to the wall when the roller is in the retracted position includes a latch member pivotally attached to the support arm bracket and a latch bracket secured to the wall for interlocking with the latch member.

20 Claims, 7 Drawing Sheets

RETRACTABLE DOOR/WINDOW AWNING

This application is a continuation-in-part of U.S. application Ser. No. 09/061,516 filed on Apr. 16, 1998.

BACKGROUND OF THE INVENTION

The present invention generally relates to retractable awnings and, more specifically, to retractable awnings having support arms and tension rafters.

There are a number of known retractable awning assemblies that support an awning or canopy to create a sheltered area. An inner end of the canopy is typically secured to a wall and an outer end of the canopy is typically secured to a roller assembly. The roller assembly is supported at its ends by support arms for movement between a retracted position, wherein the roller assembly is disposed adjacent the wall, and an extended position, wherein the roller assembly is spaced from the wall. When the roller assembly is in the retracted position, the canopy is rolled-up on the roller assembly. When the roller assembly is in the extended position, the canopy is unrolled from the roller assembly and extends between the wall and the roller assembly.

Rafter arms or tension rafters are typically provided to hold the support arms in the extended position and tension the canopy. The rafter arms typically extend from the wall to the support arms and/or roller tube. These rafter arms are provided with locks which secure the rafter arm in the extended position.

These retractable awning assemblies are often designed for use with movable support structures such as, for example, recreational vehicles, travel trailers, mobile homes, and the like. Therefore, a travel latch must be provided which holds the awning assembly in the retracted position while the support structure is moving.

While these prior awning assemblies may adequately perform their intended functions, they are relatively difficult to operate and are relatively difficult and expensive to manufacture. The rafter arm locks and the travel latches are often located where they are not easily viewed or accessed. Additionally, the rafter arm locks often must be manually locked and/or unlocked, which can be difficult or even forgotten. Accordingly, there is a need in the art for an improved retractable awning which is more user friendly and is easier and less costly to manufacture.

BRIEF SUMMARY OF THE INVENTION

The present invention provides a retractable awning which overcomes at least some of the above noted problems of the related art. According to the present invention, the awning assembly includes a roller, a flexible canopy having an inner edge for connection to a wall and an outer edge secured to the roller, and a pair of arm assemblies supporting opposite ends of the roller and operable to move the roller between a retracted position adjacent the wall and an extended position spaced from the wall. Each of the arm assemblies includes a support arm having telescoping inner and outer members and a rafter arm having telescoping inner and outer members. The support arm outer member has an upper end operably connected to the roller and the support arm inner member has a lower end pivotally securable to the wall. The rafter arm has an outer end pivotally connected to a fixed position along the support arm and an inner end pivotally securable to the wall.

In a preferred embodiment of the present invention, the support arm and the rafter arm each include telescoping inner and outer tubes and the support arm includes a bracket rigidly secured at an intermediate position along the inner tube. The outer end of the rafter arm is pivotally attached to the support arm bracket. Ideally, the support arm and rafter arm each include a button lock for automatically locking the telescoping tubes in extended relation.

According to another aspect of the present invention, an awning assembly includes a latch for locking the support arm to the wall when in the retracted position. The latch includes a latch member attached to an intermediate position along the support arm inner member and a latch bracket securable to the wall for interlocking with the latch member.

In a preferred embodiment of the present invention, the support arm includes telescoping inner and outer tubes and a bracket rigidly secured at an intermediate position along the inner tube, with the latch member pivotally attached to the bracket. The fixed intermediate position of the latch member provides relatively easy access for the operator.

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENTS

Figure 1:
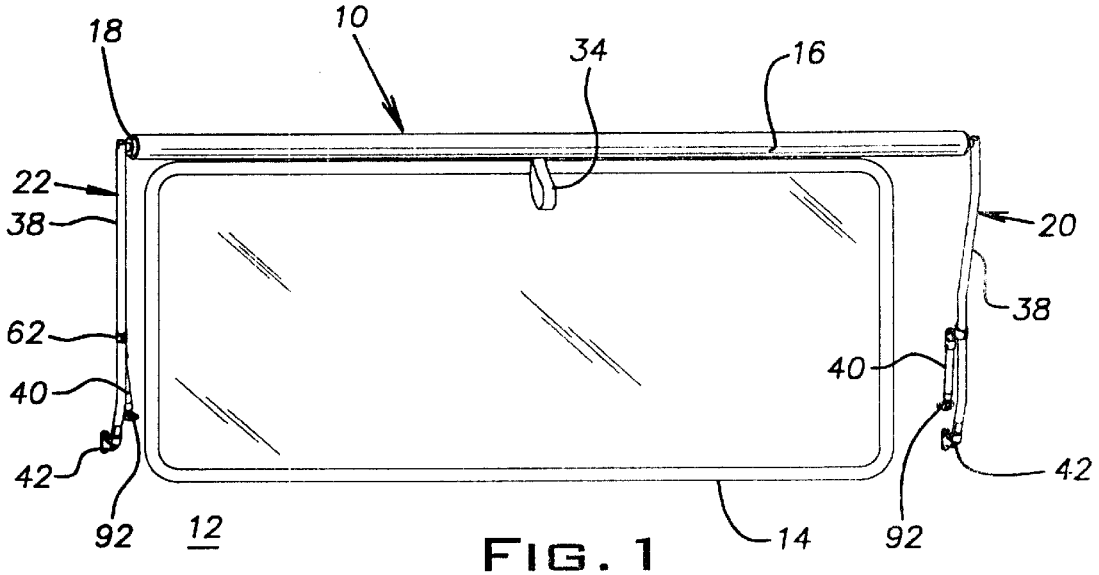
FIG. 1 is a perspective view of a door/window awning assembly according to the present invention which is in an retracted position.
Figure 2:
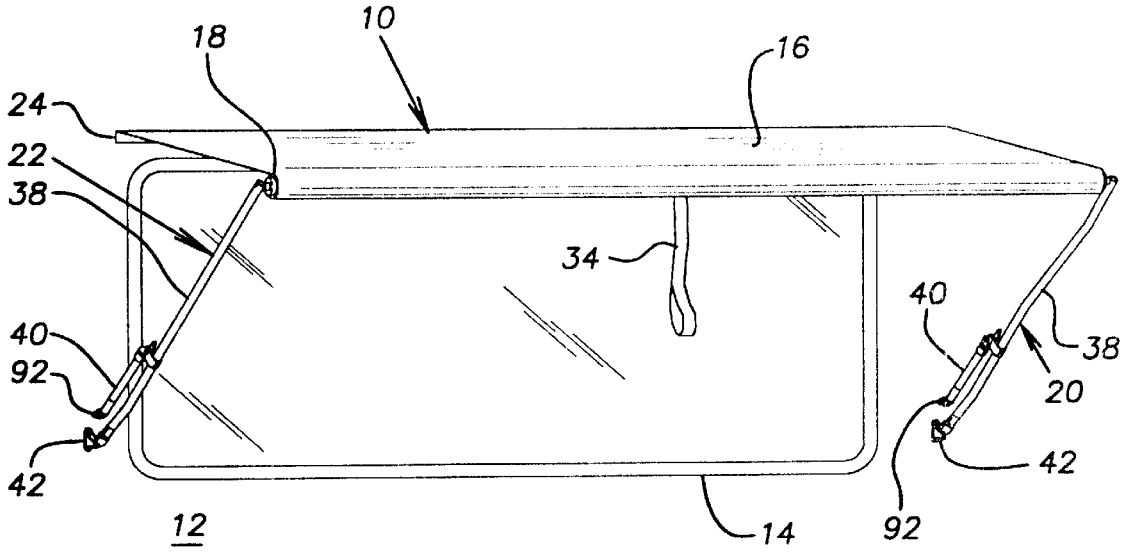
FIG. 2 is a perspective view of the door/window awning of FIG. 1 in an extended position.
Figure 9:
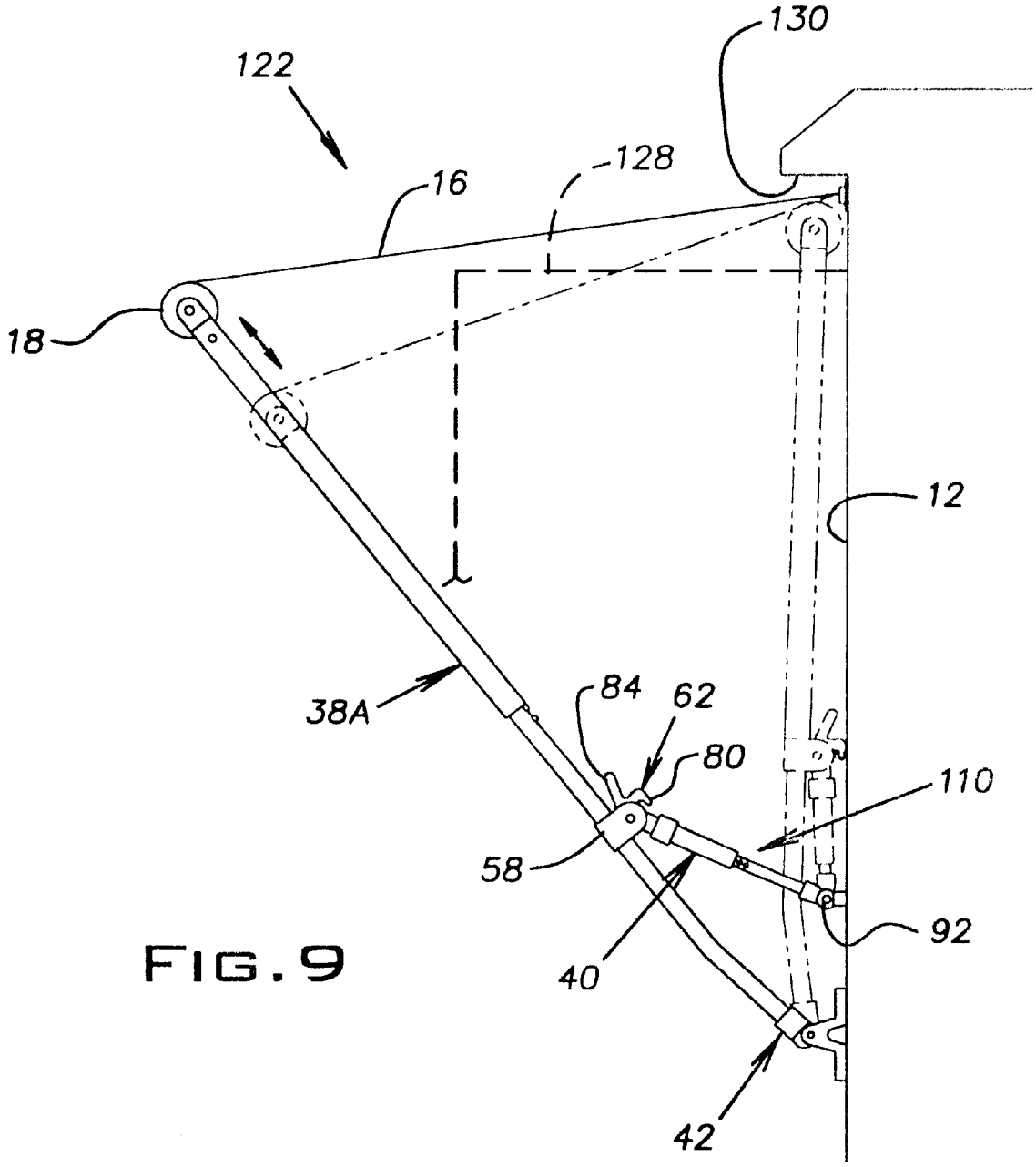
FIG. 9 is an elevational view of the second embodiment of the door/window awning in an extended position and showing retracted and intermediate positions in phantom.

FIGS. 1 and 2 illustrate a retractable awning assembly 10 according to the present invention which is attached to a vertically-extending wall 12 of a recreational vehicle. The term "recreational vehicle", as used in the specification and claims, includes campers, travel trailers, mobile homes, vans, buses, and the like. While the awning assembly 10 is particularly advantageous when attached to recreational vehicles, it can alternatively be attached to other vertically-extending walls such as, for example, the side of a building. The illustrated awning assembly 10 is shown located at a window 14 but it can be alternatively located over other items such as, for example, a door (FIG. 9).

The awning assembly 10 is operable between a retracted or stored position (shown in FIG. 1) and an extended or sheltering position (shown in FIG. 2). In the retracted position, the awning assembly 10 is in a compact configuration close to the side wall 12 of the recreational vehicle so that the recreational vehicle can travel to desired destinations. After a destination is reached, the awning assembly 10 is deployed from the retracted position to the extended position if a covered area adjacent the window 14 is desired to protect against sun, rain, and the like.

The awning assembly 10 includes an awning or canopy 16 for selectively covering an area adjacent to the wall 12, a roller assembly 18 for furling an unfurling the canopy 16, and right and left arm assemblies 20, 22 (as viewed in FIGS. 1 and 2) for supporting opposite ends of the roller assembly 18.

The canopy 16 is a sheet of flexible material such as, for example, fabric, canvas, acrylic, or nylon and is preferably rectangularly shaped. The inner or top edge of the canopy 16 is secured to the wall and the outer bottom edge of the canopy 16 is secured to the roller assembly 18. The inner and outer edges of the canopy 16 are preferably provided with an awning rope. The awning rope is preferably a polypropylene rope and is preferably sewn in a hem or pocket formed at the edges of the canopy 16.

The rope at the inner edge of the canopy 16 is preferably held by an awning rail 24 which horizontally extends along the wall 12 above the window 14 and is rigidly secured to the wall 12 by suitable fasteners. The awning rail 24 is preferably an aluminum extrusion having a channel formed therein for retaining the awning rope in a known manner. It is noted that the inner edge of the canopy 16 can be alternately secured to the wall 12 in other manners such as, for example, directly to the wall 12 or to a cover attached to the wall 12. The rope at the outer edge of the canopy 16 is held by the roller assembly 18 as described in more detail hereinafter.

Figure 3:
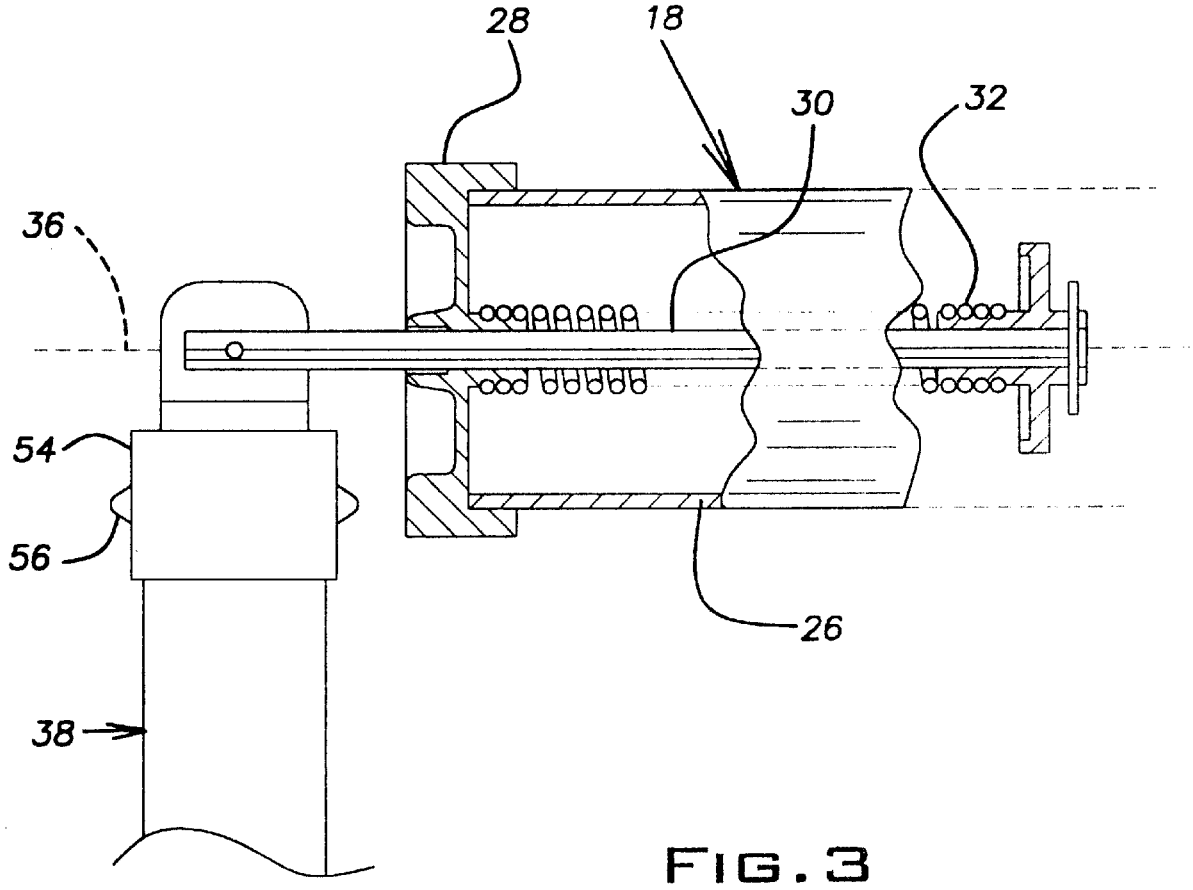
FIG. 3 is an enlarged and fragmented elevational view, partially in cross-section of the door\window awning assembly of FIGS. 1 and 2 showing an end of a roller assembly.

As best shown in FIG. 3, a suitable roller assembly 18 includes a roller tube 26, a pair of end caps 28 closing open ends of the roller tube 26, axles or bars 30 which rotatably support the roller tube 26, and a torsion spring 32. The roller tube 26 preferably has longitudinally extending channels or grooves formed therein so that the awning rope of the outer edge of the canopy 16 is secured to one of the grooves in a known manner. Additionally, an awning pull strap 34 (FIGS. 1 and 2) is preferably secured to one of the grooves in a known manner. The pull strap 34 wraps around the roller tube 26 within the canopy 16 when the canopy 16 is rolled-up on the roller tube 26 so that a looped end slightly extends out of the canopy 16 when the canopy 16 is fully rolled-up onto the roller tube 26.

Each end cap 28 is rigidly secured to the roller tube 26 for rotation therewith and has a central opening therein. The bar 30 extends through the central opening such that the roller tube 26 and the end cap 28 are free to rotate together with respect to the bar 30. The bars 30 form a rotational axis 36 for the roller tube 26 and support the roller tube 26. The torsion spring 32 is disposed around the bar 30 within the roller tube 26. The torsion spring 32 is operably connected between the roller tube 26 and the bar 30 in any known manner so that rotation of the roller tube 26 with respect to the bars 30 varies tension of the torsion spring 32. The torsion spring 32, therefore, can be preloaded for biasing the roller tube 26 to roll-up the canopy 16 onto the roller tube 26. Biased in this manner, the torsion spring 32 both tensions the canopy 16 when the awning assembly 10 is held in the extended position and assists moving the awning assembly 10 from the extended position to the retracted position. It is noted that other configurations of roller assemblies and/or tensioning mechanisms can be utilized within the scope of the present invention.

The bars 30 of the roller assembly 18 are supported by the arm assemblies 20, 22. Each arm assembly 20, 22 is disposed in a generally vertical plane at an associated side edge of the canopy 16 and an associated end of the roller assembly 18. The left and right arm assemblies 20, 22 have essentially identical structures and therefore only one will be described in detail hereinafter.

Figure 4:
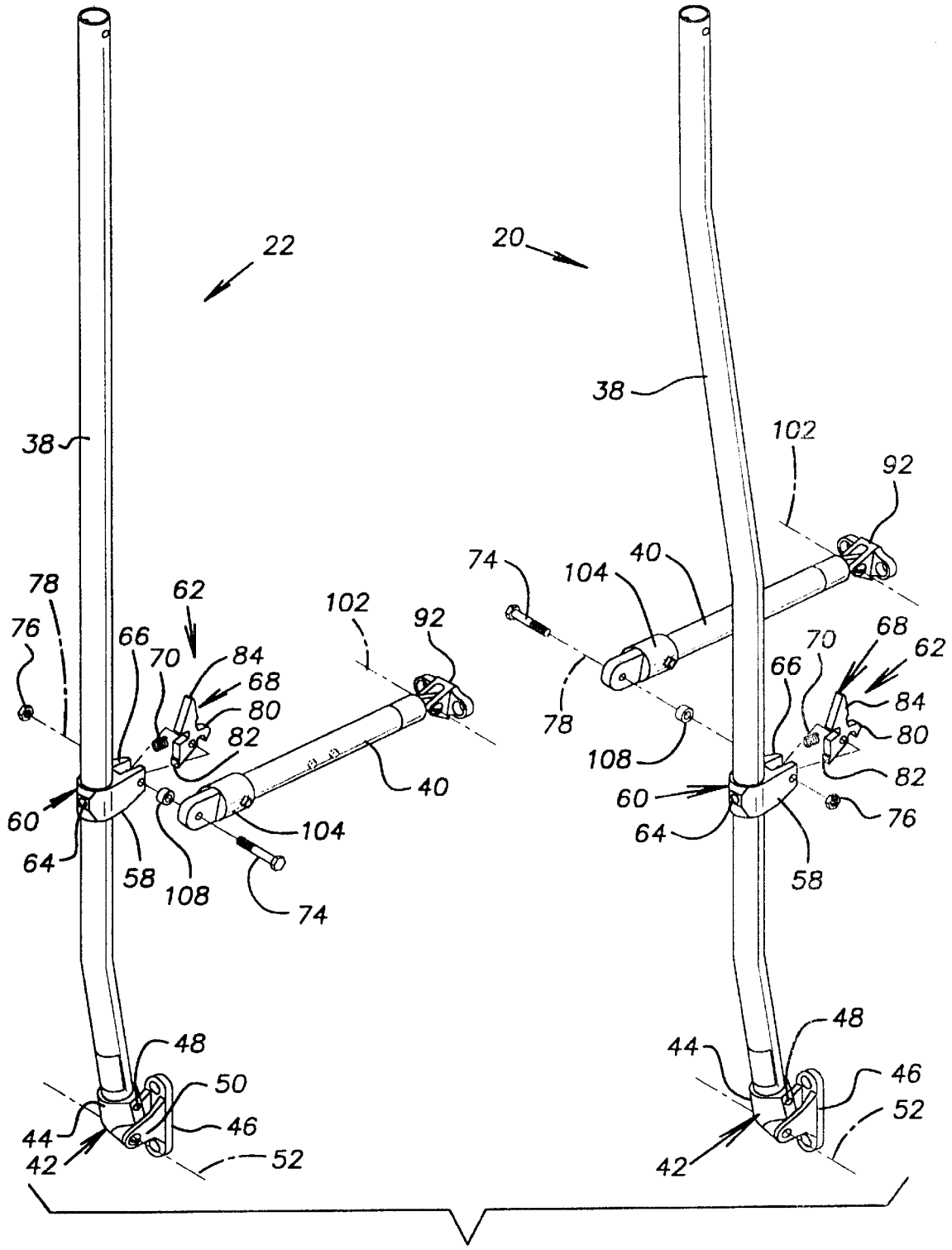
FIG. 4 is an enlarged and exploded perspective view of a support structure of the door/window awning assembly of FIGS. 1 and 2 showing a pair of support arms and a pair of rafter arms.

As best shown in FIG. 4, each arm assembly 20, 22 includes an upright arm or support arm 38 and a tension rafter or rafter arm 40. The support arm 38 has an upper end connected to the end of the roller assembly 18 and a lower end pivotally connected to the wall 12. The rafter arm 40 has a lower end pivotally connected to the wall 12 and an upper end pivotally connected to the support arm 38. When the awning assembly 10 is in the extended position, the rafter arm 40 opposes the spring bias of the roller assembly 18 to hold the awning assembly 10 in the extended position.

Each support arm 38 is a generally straight tube having a circular cross-sectional shape and a fixed length. The tube is bent to conform to the profile of the wall where needed. The tube preferably has an outer diameter of about 1 inch. The support arm 38 is preferably formed from a lightweight, high strength material such as, for example, an aluminum alloy.

The lower end of the support arm 38 is provided with a pivoting foot or lower hinge 42. The lower hinge includes a lower end cap 44 and a mounting bracket 46. The lower end cap 44 has a socket into which the lower end of the support arm 38 is closely received and is rigidly secured. The lower end cap 44 is preferably secured to the support arm 38 by a set screw 48 but can be alternatively secured in other suitable manners. The mounting bracket 46 has a generally-vertical wall engaging surface and openings which receive suitable fasteners for attaching the mounting bracket 46 to the wall 12.

The lower end cap 44 and the mounting bracket 46 have an eye and a clevis respectively which cooperate to form a pivoting joint. Preferably, a shoulder screw 50 extends through the clevis and eye which forms a horizontally-extending pivot axis 52 about which the support arm 38 pivots. The pivot axis 52 is substantially parallel to the wall 12. The lower end cap 44 and the mounting bracket 46 can alternatively be joined by other types of fasteners such as, for example a pin or rivet.

As best shown in FIG. 3, the upper end of the support arm 38 supports the roller assembly 18. The top of the support arm 38 is provided with an upper end cap 54 which has a socket into which the upper end of the support arm 38 is closely received and rigidly secured. The upper end cap 54 is preferably secured to the support arm by rivets 56, but can be alternatively secured in other manners.

The upper end cap 54 and the roller assembly bar 30 are preferably secured together in a manner which allows rotation of the bar 30, relative to the upper end cap 54, about only one axis. The bar 30 cannot rotate about the rotational axis 36 or the longitudinal axis of the support arm 38. The bar can, however, rotate about a horizontally-extending pivot axis which is substantially perpendicular to both the wall 12 and the pivot axis 52 at the lower end of the support arm 38. In the illustrated embodiment the pivot axis is formed by a pin which extends through the bar 30 and the upper end cap 54. The bar 30 and upper end cap 54, however, can be alternately joined in other suitable manners such as, for example, by a screw or rivet.

As best shown in FIG. 4, an intermediate bracket 58 is rigidly secured to the support arm 38 at an intermediate position along the support arm 38 where it is located between and spaced apart from the two end caps 44, 54. The intermediate bracket 58 cooperates with the rafter arm 40 to form a pivoting joint 60 therebetween as described in more detail hereinafter. The intermediate bracket 58 also supports and carries a travel or support arm latch 62 for locking the support tube 38 in the retracted position adjacent the wall 12 and therefore locking the awning assembly 10 in the retracted position. The intermediate bracket 58 has a circular passage through which the support arm 38 is closely received and rigidly secured. The intermediate bracket 58 is preferably secured to the support arm 38 by a set screw 64 but can be alternatively secured in other suitable manners. The intermediate bracket 58 also has a pair of arms 66 forming a clevis which cooperates with both the latch 62 and the outer end of the rafter arm 40 as described in more detail hereinafter.

The latch 62 includes a latch member 68 movable between a locking position (shown in FIGS. 4 and 5) and a nonlocking position, a compression spring 70 for biasing the latch member 68 to the locking position, and a latch bracket 72 for interlocking with the latch member 68. Preferably, the latch member 68 is located between the bracket arms 66 and is pivotally joined to the intermediate bracket 58 by a shoulder bolt 74 which extends through openings in both the latch member 68 and arm bracket 66. The bolt 74 is retained in place by a suitable nut 76. The latch member 68, however, can be pivotally joined by other types of fasteners such as, for example a pin or rivet. The bolt 74 forms a horizontally-extending pivot axis 78 about which the latch member 68 can pivot relative to the intermediate bracket 58. The pivot axis 78 is substantially parallel to the wall 12 and the pivot axis 52 of the lower hinge 42.

The latch member 68 has a hook 80 at a rear side thereof. As the latch member 68 pivots, the hook 80 is raised and lowered between the locking and nonlocking positions. The compression spring 70 is located in a groove or slot at the forward side of the latch member 68 and is positioned between the intermediate bracket 58 and the latch member 68 above the pivot axis 78. The compression spring 70 pivots the latch member 68 to bias the hook 80 downward into the locking position. The lower end of the latch member 68 is provided with an engagement surface or stop 82 which engages the intermediate bracket 58 and/or the support arm 38 to prevent the latch member 68 from rotating beyond the locking position. It is noted that the compression spring 70 is retained in position by the bracket arms 66 and the latch member 68. The upper end of the latch member 68 is provided with a handle 84 which can be manually pulled, with enough force to overcome the bias of the compression spring 70, to pivot the latch member 68 and move the hook 80 upward into the nonlocking position. Preferably, the hook 80 is provided with a camming surface shaped to automatically move the hook upward out of the locking position upon engagement with the latch bracket 72 so that the latch 62 automatically locks upon movement of the awning assembly 10 from the extended position to the retracted position.

Figure 5:
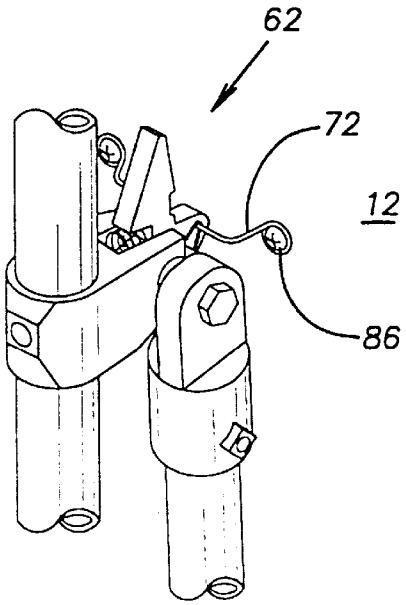
FIG. 5 is an enlarged and fragmented perspective view of the door/window awning of FIG. 1 showing a travel latch secured to an intermediate bracket of the support arm.

As best shown in FIG. 5, the latch bracket 72 is secured to the wall 12 generally at the height of the intermediate bracket 58 of the support arm 38 when the awning assembly 10 is in the retracted position. The latch bracket 72 has an engagement portion sized and shaped to interlock with the hook 80 of the latch member 68 and mounting portions sized and shaped to receive fasteners 86 for attaching the latch bracket 72 to the wall 12. Preferably, the latch bracket 72 is a formed wire.

Figure 6:
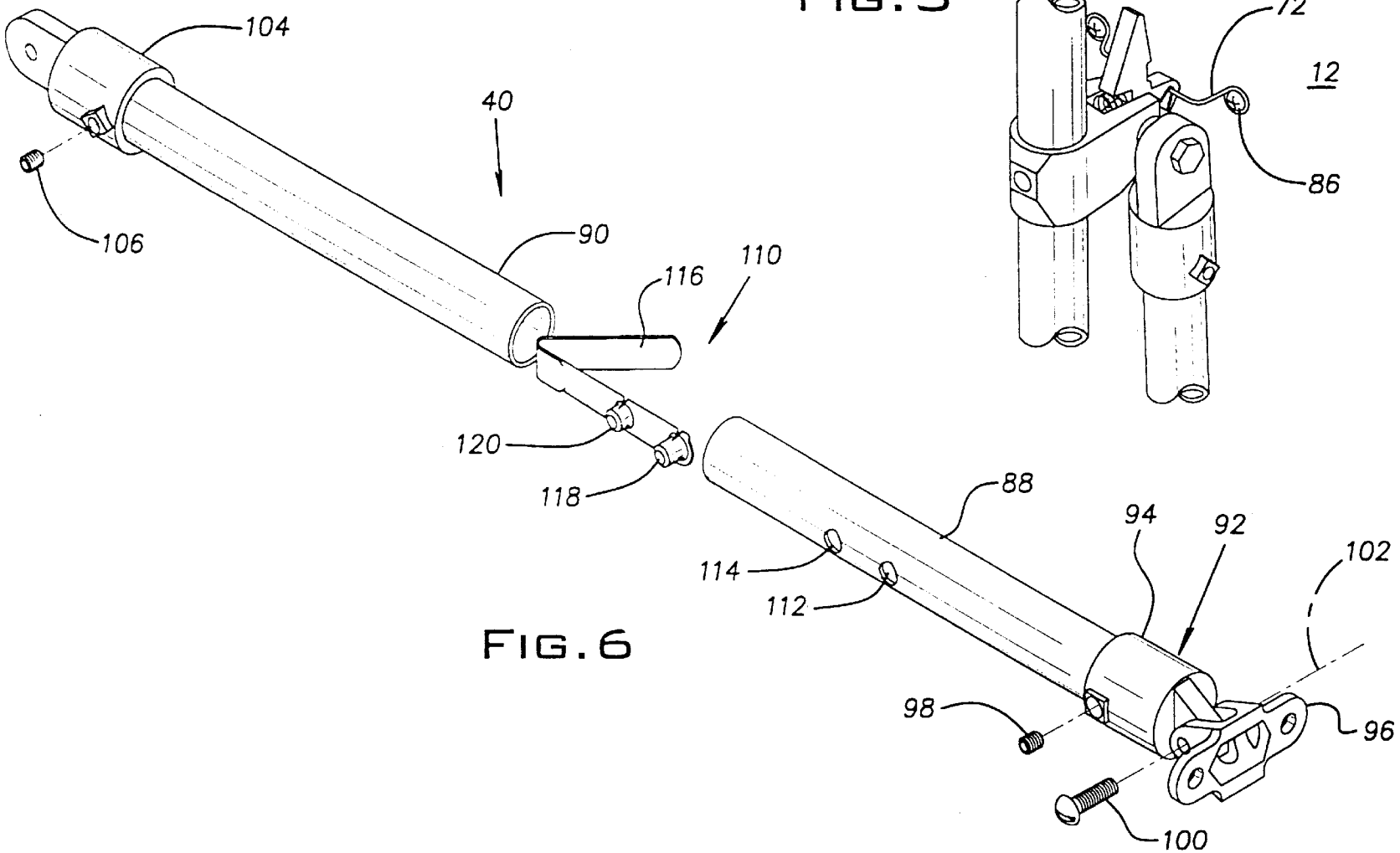
FIG. 6 is an enlarged and exploded perspective view of one of the rafter arms of FIG. 4.

As best shown in FIG. 6, each rafter arm 40 preferably includes telescoping inner and outer members 88, 90 so that the length of the rafter arm 40 is variable. The outer member 90, which is disposed at the upper end of the rafter arm 40, has a sliding relationship with the inner member 88. The inner and outer members 88, 90 are each preferably straight tubes having a circular cross-sectional shape. The inner and outer members 88, 90 preferably have outer diameters of about 0.88 inches and about 0.75 inches respectively. The inner and outer members 88, 90 are each preferably formed from a lightweight, high strength material such as, for example, an aluminum alloy.

The lower end of the rafter arm 40 is provided with a pivoting foot or lower hinge 92. The lower hinge 92 of the rafter arm 40 is substantially similar to the lower hinge 42 of the support arm 38 and includes a lower end cap 94 and a mounting bracket 96. The lower end cap 94 has a socket into which the lower end of the inner member 88 is closely received and is rigidly secured. The lower end cap 94 is preferably secured to the inner member 88 by a set screw 98 but can be alternatively secured in other suitable manners. The mounting bracket 96 has a generally-vertical wall engaging surface and openings which receive suitable fasteners for attaching the mounting bracket 96 to the wall 12. The lower end cap 94 and the mounting bracket 96 have an eye and a clevis respectively which cooperate to form a pivoting joint of the lower hinge 92. Preferably, a shoulder screw 100 extends through the clevis and eye to form a horizontally-extending pivot axis 102 about which the lower end of the rafter arm 40 pivots. The pivot axis 102 is substantially parallel to both the wall 12 and the pivot axis 52 of the support arm lower hinge 42. The lower end cap 94 and the mounting bracket 96 can be alternatively joined by other suitable means such as, for example, a pin or rivet.

The upper end of the rafter arm 40 is provided with an upper end cap 104. The upper end cap 104 is substantially similar to the lower end cap 94 of the rafter arm 40 and has a socket into which the upper end of the outer member 90 is closely received and rigidly secured. The upper end cap 104 is preferably secured to the outer member 90 by a set screw 106 but can be alternatively secured in other suitable manners.

As best shown in FIG. 4, the upper end cap 104 has an eye which is pivotally attached to the intermediate bracket 58 of the support arm 38. The eye is located laterally inward of the bracket arms 66 with the bolt 74 extending therethrough so that the upper end of the rafter arm 40 pivots about the pivot axis 78 defined by the bolt 74. Preferably, a spacer 108 is provided between the eye and the inner side of the intermediate bracket 58.

As best shown in FIG. 6, the rafter arm 40 is also provided with a lock 110 for automatically locking the inner and outer members 88, 90 at an extended position to prevent them from telescopingly closing or retracting. The rafter arm lock 110 preferably includes lower and upper openings 112, 114 formed in the inner member 88 and a spring member 116 located within the inner member 88.

The illustrated spring member 116 is generally elongate with a bend or fold which forms a pivot point. The spring member 116 has lower and upper buttons 118, 120 located near a free end and spaced from the pivot point. When the spring member 116 is in the inner member 88, the lower and upper buttons 118, 120 are resiliently biased outward through the openings 112, 114 in the inner member 88.

As the rafter arm 40 is telescopingly extended, the buttons 118, 120 automatically project through the openings 112, 114 when the upper opening 114 is outside of the outer member 90. The lower button 118 is taller than the upper button 120 so that the upper button 120 will fully retract when the lower button 118 is manually pressed into the inner member 88. Note that the lower button 118 is located farther from the pivot point than the upper button 120. The rafter arm 40 is prevented from telescopingly retracting because the end of the outer member 90 engages the upper button 120. Once the lower button 118 is manually pressed into the lower opening 112, the rafter arm 40 is free to retract.

As best shown in FIG. 1, the support arms 38 and the rafter arms 40 each have a substantially parallel relationship with the wall 12 of the recreational vehicle and the canopy 16 is fully rolled-up on the roller assembly 18 when the awning assembly 10 is the retracted position. The support arms 38 and the rafter arms 40 are laterally adjacent one another so that the awning assembly 10 is in close relationship with the wall 12.

To open the awning assembly 10, the operator grasps the awning pull strap 34 and pulls to slightly unroll, such as about 1 inch, the canopy 16. The support arm latches 62 are then manually unlocked while continuing to pull on the awning pull strap 34. The support arm latches 62 are unlocked by pulling the handle 84 of the latch member 68 to overcome the bias of the compression spring 70 until the hook 80 is released from the latch bracket 72 (best seen in FIGS. 4 and 5).

As best shown in FIG. 2, the support arms 38 downwardly pivot outward about the pivot axis 52 of the lower hinge 42 as the roller assembly 18 is pulled outward by the awning pull strap 34. As the roller assembly 18 moves outwardly, the roller tube 26 rotates about the bars 30 and the canopy 16 is unrolled from the roller tube 26. As the support arms 38 pivot, the rafter arms 40 downwardly pivot outward about the pivot axis 102 of the lower hinge 92 and also pivot about the pivot axis 78 of the support-arm intermediate bracket 58. The length of the rafter arms 40 is increased as the inner and outer members 88, 90 slide relative to one another.

The rafter arm locks 110 automatically lock when the rafter arms are extended to predetermined lengths. The rafter arm locks 110 automatically engage as the upper spring button 120 projects through the upper opening 114 in the inner member 88 when fully outside the outer member 90. When the awning assembly is in the extended position, the pull strap 34 is released and the upper spring button 120 stops the rafter arm 40 from telescoping closed and therefore prevents the awning assembly 10 from unintentionally retracting. Preferably, the pull strap 34 is then secured so that it does not become unattached and blow away.

To close the awning assembly 10, the operator grasps the awning pull strap 34 and slightly pulls to remove tension from the rafter arm locks 110. The rafter arm locks 110 are then manually unlocked and the canopy 16 is allowed to roll-up onto the roller tube 26 by the bias of the torsion spring 32. The rafter arm locks 110 are unlocked by pushing the lower spring button 118 into the inner member 88 so that the outer member 90 can telescope over the upper spring button 120.

As the canopy 16 is rolled onto the roller assembly 18, the support arms 38 upwardly pivot inward about the pivot axis 52 of the lower hinge 42. As the support arms 38 pivot, the rafter arms 40 upwardly pivot inward about pivot axis 102 of the lower hinge 92 and also pivot about the pivot axis 78 of the support-arm intermediate bracket 58. The length of the rafter arms 40 is decreased as the inner and outer members 88, 90 slide relative to one another. The support arm latches 62 automatically lock as the awning assembly 10 reaches the retracted position. When the latch member 68 engages the latch bracket 72, the hook 80 is upwardly cammed over the engagement portion of the latch bracket 72 as the bias of the compression spring 70 is overcome. The hook 80 is then resiliently pushed downward by the compression spring 70 once the hook 80 extends behind the engagement portion of the latch bracket 72 to interlock the latch member 68 with the latch bracket 72. When the awning assembly 10 is in the retracted position, the canopy 16 is fully rolled-up on the roller assembly 18 and the support arm latches 62 prevent the support arms 38 from downwardly pivoting outward, and therefore prevent the awning assembly 10 from unintentionally deploying. Closed and locked in this manner, the awning assembly 10 is ready for travel.

It can be seen from the above description, that the awning assembly 10 of the present invention is very user friendly and is relatively easy to manufacture. Note that both the travel latches 62 and the rafter arm locks 110 are located at inward facing sides of the arm assemblies 20, 22 where they are easily viewed and accessed and are both located at intermediate heights where they are easily viewed and reached. Additionally, the travel latches 62 and the rafter arm locks 110 both automatically lock and are relatively easy to unlock.

Figure 7:
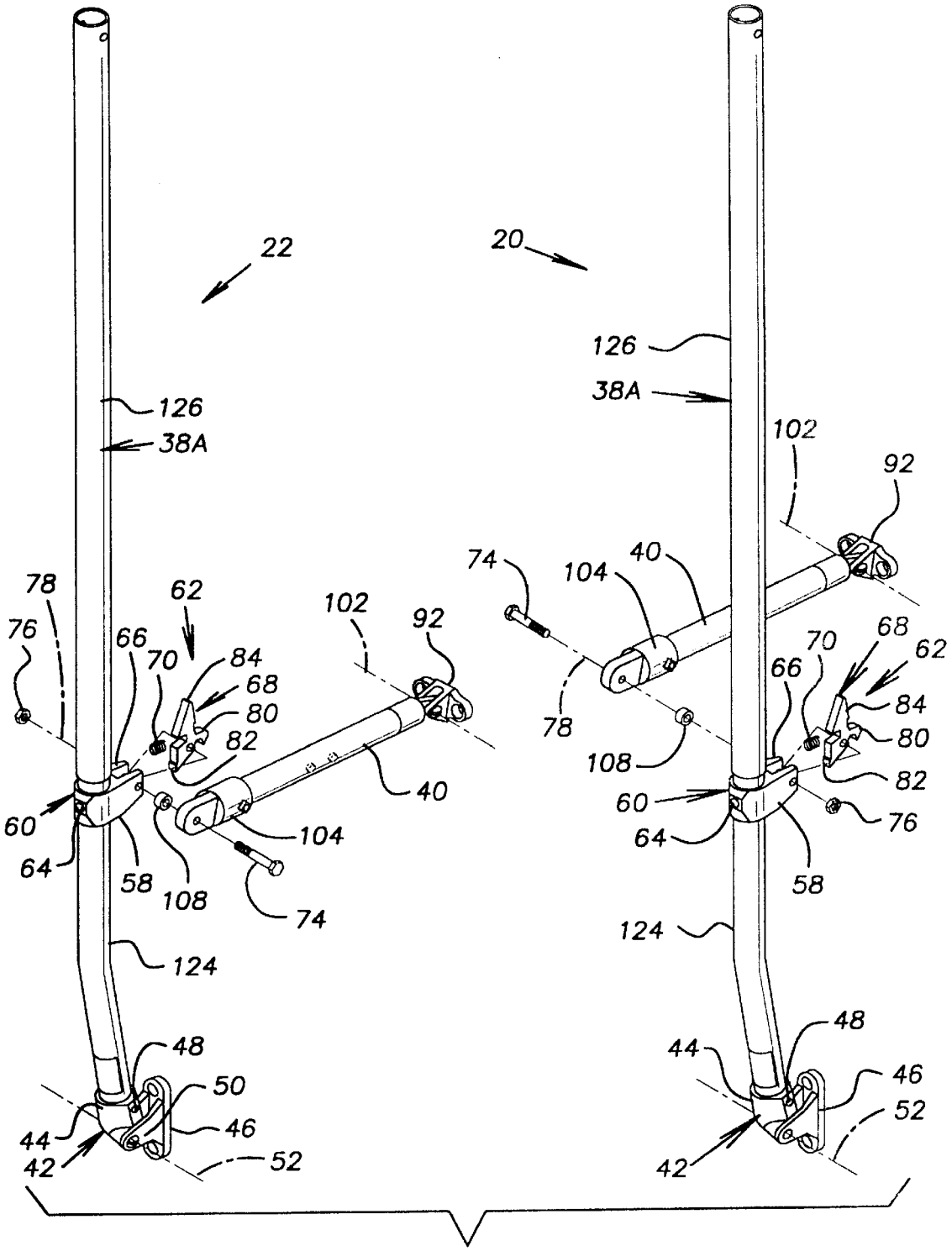
FIG. 7 is an enlarged and exploded perspective view of a second embodiment of the support structure of the door/window awning assembly of FIGS. 1 and 2 showing a pair of support arms and a pair of rafter arms.
Figure 8:
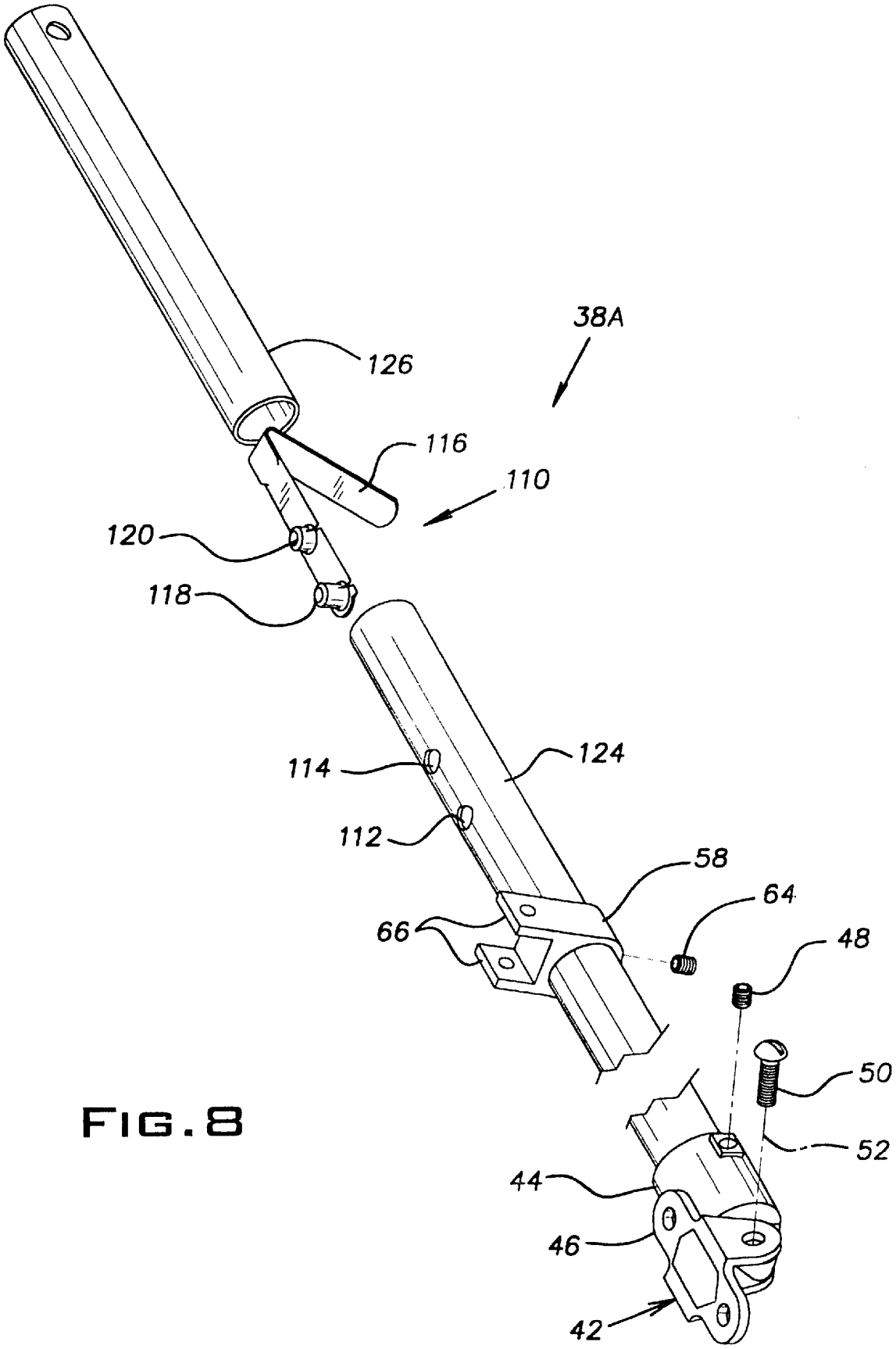
FIG. 8 is an enlarged and exploded perspective view of one of the support arms of FIG. 7.

FIGS. 7–9 illustrates a retractable awning assembly 122 according to a second embodiment of the present invention. The awning assembly 122 according to the second embodiment is substantially similar to the awning assembly 10 according to the first embodiment except that the length of the support arms 38A can be changed between a retracted or storage length and an extended length. Therefore, the above description with regard to the first embodiment also applies to the second embodiment. It is noted that like reference numbers are utilized for like structure throughout the figures.

As best shown in FIG. 8, each support arm 38A preferably includes telescoping inner and outer members 124, 126 so that the length of the support arm 38A is variable between the retracted length and the extended length. The outer member 126, which is disposed at the upper end of the support arm 38A, has a sliding relationship with the inner member 124. The inner and outer members 124, 126 are each preferably tubes having a circular cross-sectional shape. The inner and outer members 124, 126 preferably have outer diameters of about 1.00 inch and about 1.13 inches respectively. The inner and outer members 124, 126 are each preferably formed from a lightweight, high strength material such as, for example, an aluminum alloy.

Each support arm 38A is also provided with a lock 110 for automatically locking the inner and outer members 124, 126 in the extended position to prevent them from telescopingly closing or retracting. The support arm lock 110 preferably similar to the rafter arm lock describes hereinabove and preferably includes lower and upper openings 112, 114 formed in the inner member 124 and a spring member 116 located within the inner member 124.

The illustrated spring member 116 is generally elongate with a bend or fold which forms a pivot point. The spring member 116 has lower and upper buttons 118, 120 located near a free end and spaced from the pivot point. When the spring member 116 is in the inner member 124, the lower and upper buttons 118, 120 are resiliently biased outward through the openings 112, 114 in the inner member 124.

As the support arm 38A is telescopingly extended, the buttons 118, 120 automatically project through the openings 112, 114 when the upper opening 114 is outside of the outer member 126. The lower button 118 is taller than the upper button 120 so that the upper button 120 will fully retract when the lower button 118 is manually pressed into the inner member 124. Note that the lower button 118 is located farther from the pivot point than the upper button 120. The support arm 38A is prevented from telescopingly retracting because the end of the outer member 126 engages the upper button 120. Once the lower button 118 is manually pressed into the lower opening 112, the support arm 3A is free to retract.

The intermediate bracket 58 is rigidly secured to the inner member 124 at an intermediate position between the lower opening 112 and the lower end cap 44. The top surface of the intermediate bracket 58, therefore, acts as a stop or abutment which supports the outer member 126 when the support arm 38A is retracted.

As best shown in FIG. 9, the support arms 38A and the rafter arms 40 each have a substantially parallel relationship with the wall 12 of the recreational vehicle and the canopy 16 is fully rolled-up on the roller assembly 18 when the awning assembly 122 is the retracted position (shown in phantom). The support arms 38A and the rafter arms 40 are laterally adjacent one another so that the awning assembly 122 is in close relationship with the wall 12.

To open the awning assembly 122, the operator grasps the awning pull strap 34 (FIG. 1) and pulls to slightly unroll, such as about 1 inch, the canopy 16. The support arm latches 62 are then manually unlocked while continuing to pull on the awning pull strap 34. The support arm latches 62 are unlocked by pulling the handle 84 of the latch member 68 to overcome the bias of the compression spring 70 (FIG. 7) until the hook 80 is released from the latch bracket 72 (FIG. 5).

The support arms 38A downwardly pivot outward about the pivot axis 52 of the lower hinge 42 as the roller assembly 18 is pulled outward by the awning pull strap 34. As the roller assembly 18 moves outwardly, the roller tube 26 rotates about the bars 30 and the canopy 16 is unrolled from the roller tube 26. As the support arms 38A pivot, the rafter arms 40 downwardly pivot outward about the pivot axis 102 of the lower hinge 92 and also pivot about the pivot axis 78 of the support-arm intermediate bracket 58. The length of the rafter arms 40 is increased as the inner and outer members 88, 90 slide relative to one another.

The rafter arm locks 110 automatically lock when the rafter arms 40 are extended to predetermined lengths. The rafter arm locks 110 automatically engage as the upper spring button 120 projects through the upper opening 114 in the inner member 88 when fully outside the outer member 90. When the awning assembly 122 is in the extended position, the pull strap 34 is released and the upper spring button 120 stops the rafter arm 40 from telescoping closed and therefore prevents the awning assembly 122 from unintentionally retracting. Preferably, the pull strap 34 is then secured so that it does not become unattached and blow away.

One of the support arms 38A is grasped above the intermediate bracket 58 and pulled to outwardly pivot the support arm 38A away from the wall 12 to remove tension from the rafter arm lock 110. The rafter arm lock 110 is manually released and the support arm 38A is then pushed to inwardly pivot the support arm 38A toward the wall 12 while lifting the outer member 126 until the support arm lock 110 automatically deploys. The support arm lock 110 automatically deploys as the upper spring button 120 projects through the upper opening 114 in the inner member 124 when fully outside the outer member 126. The upper spring button 120 holds the outer member 126 in the extended position and prevents the support arm 38A from telescoping closed. The support arm 38A is then pulled to outwardly pivot the support arm 38A away from the wall 12 to again lock the rafter arm lock 110. This support arm 38A extension procedure is then repeated on the other support arm 38A.

To close the awning assembly 122, one of the support arms 38A is pulled to outwardly pivot the support arm 38A away from the wall 12 to remove tension from the rafter arm lock 110. The rafter arm lock 110 is manually released and the support arm 38A is pushed to inwardly pivot the support arm 38A toward the wall 12 while releasing the support arm lock 110 and lowering the outer member 126 to the intermediate bracket 58. With the outer member 126 supported by the intermediate bracket 58, the support arm 38A is again pulled to outwardly pivot the support arm 38A away from the wall 12 and relatch the rafter arm lock 110. This support arm 38A retraction procedure is then repeated on the other support arm 38A.

When both support arms 38A are retracted, the operator grasps the awning pull strap 34 and slightly pulls to remove tension from the rafter arm locks 110. The rafter arm locks 110 are then manually unlocked and the canopy 16 is allowed to roll-up onto the roller tube 26 by the bias of the torsion spring 32.

As the canopy 16 is rolled onto the roller assembly 18, the support arms 38A inwardly pivot about the pivot axis 52 of the lower hinge 42. As the support arms 38A pivot, the rafter arms 40 inwardly pivot about pivot axis 102 of the lower hinge 92 and also pivot about the pivot axis 78 of the support-arm intermediate bracket 58. The length of the rafter arms 40 is decreased as the inner and outer members 88, 90 slide relative to one another. The support arm latches 62 automatically lock as the awning assembly 122 reaches the retracted position. When the latch member 68 engages the latch bracket 72, the hook 80 is upwardly cammed over the engagement portion of the latch bracket 72 as the bias of the compression spring 70 is overcome. The hook 80 is then resiliently pushed downward by the compression spring 70 once the hook 80 extends behind the engagement portion of the latch bracket 72 to interlock the latch member 68 with the latch bracket 72. When the awning assembly 122 is in the retracted position, the canopy 16 is fully rolled-up on the roller assembly 18 and the support arm latches 62 prevent the retracted support arms 38A from downwardly pivoting outward, and therefore prevent the awning assembly 122 from unintentionally deploying. Closed and locked in this manner, the awning assembly 122 is ready for travel.

It can be seen from the above description, that the awning assembly 122 according to the second embodiment of the present invention is particularly advantageous when the awning assembly 122 is located at a door 128 and an obstruction 130 on the recreational vehicle limits the length of the support arms 38A in the stored position (FIG. 9). With the support arms 38A deployed and at their storage or retracted length, the canopy 16 can interfere with the pathway of the door 128. The telescoping support arms 38A, however, enable the canopy 16 to be raised and held at an extended location above the path of the door 128 so that there is no interference therebetween.

Although particular embodiments of the invention have been described in detail, it will be understood that the invention is not limited correspondingly in scope, but includes all changes and modifications coming within the spirit and terms of the claims appended hereto.

What is claimed is:

1. A retractable awning assembly for mounting to a wall, said awning assembly comprising:

a roller;

a flexible canopy having an inner edge for connection to the wall and an outer edge secured to said roller; and a pair of arm assemblies supporting opposite ends of said roller and operable to move said roller between a retracted position wherein said canopy is furled on said roller and an extended position wherein said canopy is unfurled from said from said roller, each of said arm assemblies having a support arm and a rafter arm, said support arm including telescoping inner and outer members and said rafter arm including telescoping inner and outer members, said support arm outer member having an upper end operably connected to said roller, said rafter arm having an outer end pivotally connected to a fixed position along said support arm such that said outer end of said rafter arm remains at said fixed position during movement of said roller between the retracted position and the extended position.

2. The retractable awning according to claim 1, wherein said support arm inner and outer members are tubes having circular cross-sections.

3. The retractable awning according to claim 2, wherein said rafter arm inner and outer members are tubes having circular cross-sections.

4. The retractable awning according to claim 1, wherein said rafter arm outer member has an outer end pivotally connected to a fixed position along said support arm inner member.

5. The retractable awning according to claim 1, wherein said support arm includes a button lock for automatically locking the inner and outer members in an extended relation, said lock including an opening in said inner member, a button sized for passage through the opening, and a spring member in said inner member for resiliently biasing said button outwardly through said opening when said outer member is past the opening such that an end of said outer member engages said button to prevent said outer member from passing over said inner member.

6. The retractable awning according to claim 1, wherein said rafter arm includes a button lock for automatically locking the inner and outer members in an extended relation, said lock including an opening in said inner member, a button sized for passage through the opening, and a spring member in said inner member for resiliently biasing said button outwardly through said opening when said outer member is past the opening such that an end of said outer member engages said button to prevent said outer member from passing over said inner member.

7. The retractable awning according to claim 1, further comprising a latch secured to an intermediate position along said support arm inner member for locking said support arm to the wall when in the retracted position.

8. The retractable awning according to claim 7, wherein said latch includes a latch member attached to said support arm and movable between a locking position and a non-locking position and a latch bracket securable to the wall for interlocking with said latch member.

9. The retractable awning according to claim 1, wherein said outer end of said rafter arm is pivotally connected to a fixed position along the support arm inner member.

10. A retractable awning assembly for mounting to a wall, said awning assembly comprising:

a roller;

a flexible canopy having an inner edge for connection to the wall and an outer edge secured to said roller; and a pair of arm assemblies supporting opposite ends of said roller and operable to move said roller between a retracted position wherein said canopy is furled on said roller and an extended position wherein said canopy is unfurled from said from said roller, each of said arm assemblies having a support arm and a rafter arm, said support arm including telescoping inner and outer members and said rafter arm including telescoping inner and outer members, said support arm outer member having an upper end operably connected to said roller, said rafter arm having an outer end pivotally connected to a fixed position along said support arm, wherein said support arm includes a bracket rigidly secured at an intermediate position along said inner member, and said rafter arm is pivotably attached to said bracket.

11. The retractable awning according to claim 10, further comprising a latch attached to said bracket for locking said support arm to the wall when in said retracted position.

12. A retractable awning assembly for mounting to a wall, said awning assembly comprising:

a roller;

a flexible canopy having an inner edge for connection to the wall and an outer edge secured to the roller;

a pair of arm assemblies supporting opposite ends of said roller and operable to move said roller between a retracted position wherein said canopy is furled on said roller and an extended position wherein said canopy is unfurled from said roller, each of said arm assemblies having a support arm and a rafter arm, said support arm including telescoping inner and outer members, said support arm having an upper end operably connected to said roller, said rafter arm having an outer end operably connected to said support arm; and a latch for locking said support arm in said retracted position, said latch including a latch member attached to an intermediate position along said support arm at a fixed position from the lower end of the support arm and a latch bracket securable to the wall for interlocking with said latch member, wherein said latch member is movable between a locking position and a nonlocking position and said latch includes a spring for biasing said latch member to the locking position.

13. The retractable awning according to claim 12, wherein said latch bracket is a formed wire having a circular cross-section.

14. The retractable awning according to claim 12, wherein said latch member is adapted to automatically interlock with said latch bracket when said roller is moved from said extended position to said retracted position.

15. The retractable awning according to claim 12, wherein said outer end of said rafter arm is pivotally connected to a fixed position along the support arm inner member.

16. A retractable awning assembly for mounting to a wall, said awning assembly comprising:

a roller;

a flexible canopy having an inner edge for connection to the wall and an outer edge secured to the roller;

a pair of arm assemblies supporting opposite ends of said roller and operable to move said roller between a retracted position wherein said canopy is furled on said roller and an extended position wherein said canopy is unfurled from said roller, each of said arm assemblies having a support arm and a rafter arm, said support arm including telescoping inner and outer members, said support arm having an upper end operably connected to said roller, said rafter arm having an outer end operably connected to said support arm; and a latch for locking said support arm in said retracted position, said latch including a latch member attached to an intermediate position along said support arm at a fixed distance from the lower end of the support arm and a latch bracket securable to the wall for interlocking with said latch member, wherein said latch member is pivotally attached to said support arm.

17. A retractable awning assembly for mounting to a wall, said awning assembly comprising:

a roller;

a flexible canopy having an inner edge for connection to the wall and an outer edge secured to the roller;

a pair of arm assemblies supporting opposite ends of said roller and operable to move said roller between a retracted position wherein said canopy is furled on said roller and an extended position wherein said canopy is unfurled from said roller, each of said arm assemblies having a support arm and a rafter arm, said support arm including telescoping inner and outer members, said support arm having an upper end operably connected to said roller, said rafter arm having an outer end operably connected to said support arm; and a latch for locking said support arm in said retracted position, said latch including a latch member attached to an intermediate position along said support arm at a fixed distance from the lower end of the support arm and a latch bracket securable to the wall for interlocking with said latch member, wherein said support arm inner and outer members are tubes and said support arm includes a bracket rigidly secured at an intermediate position along said inner member, and said latch member is pivotally attached to said bracket.

18. The retractable awning according to claim 17, wherein said support arm outer member has an upper end operably connected to said roller and said support arm inner member has a lower end pivotally securable to the wall.

19. The retractable awning according to claim 17, wherein said rafter arm is pivotally attached to said bracket.

20. A retractable awning assembly for mounting to a wall, said awning assembly comprising:

a roller;

a flexible canopy having an inner edge for connection to the wall and an outer edge secured to the roller;

a pair of arm assemblies supporting opposite ends of said roller and operable to move said roller between a retracted position wherein said canopy is furled on said roller and an extended position wherein said canopy is unfurled from said from said roller, each of said arm assemblies having a support arm and a rafter arm, said support arm including telescoping inner and outer tubes, a button lock for automatically locking the inner and outer tubes in an extended relation and a bracket rigidly secured at an intermediate position along said inner tube, said rafter arm including telescoping inner and outer tubes and a button lock for automatically locking the inner and outer tubes in an extended relation, said support arm outer tube having an upper end operably connected to said roller, said rafter arm outer tube having an outer end pivotally connected to said bracket of said support arm; and a latch for automatically locking said support arm in said retracted position, said latch including a latch member pivotally attached to said bracket of said support arm and a latch bracket securable to the wall for interlocking with said latch member.

* * * * *